US012252762B2

(12) United States Patent
Kamio

(10) Patent No.: US 12,252,762 B2
(45) Date of Patent: Mar. 18, 2025

(54) TITANIUM ALLOY

(71) Applicant: NIPPON STEEL CORPORATION, Tokyo (JP)

(72) Inventor: Hiroshi Kamio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 438 days.

(21) Appl. No.: 17/771,400

(22) PCT Filed: Oct. 30, 2019

(86) PCT No.: PCT/JP2019/042525
§ 371 (c)(1),
(2) Date: Apr. 22, 2022

(87) PCT Pub. No.: WO2021/084642
PCT Pub. Date: May 6, 2021

(65) Prior Publication Data

US 2022/0364206 A1 Nov. 17, 2022

(51) Int. Cl.
*C22C 14/00* (2006.01)

(52) U.S. Cl.
CPC ..... *C22C 14/00* (2013.01)

(58) Field of Classification Search
CPC ..... C22C 14/00; C22F 1/183
See application file for complete search history.

(56) References Cited

U.S. PATENT DOCUMENTS 5,201,457 A * 4/1993 Kitayama ..... C22C 14/00 228/144
2009/0004042 A1 1/2009 Matsumoto et al.
2011/0315278 A1 12/2011 Yashiki
2016/0108508 A1 4/2016 Thomas et al.

FOREIGN PATENT DOCUMENTS

| | | | |
|---|---|---|---|
| CN | 106103757 | A | 11/2016 |
| JP | 6-25779 | A | 2/1994 |
| JP | 2012-12633 | A | 1/2012 |
| WO | WO 2007/077645 | A1 | 7/2007 |

OTHER PUBLICATIONS

Ahmed, Yassin Mustafa, et al. "Titanium and its alloy." International Journal of Science and Research 3.10 (2014): 1351-1361.*
Ueda et al., "Effect of Chromium Addition on the Corrosion Resistance of Ti—Ni-(Pd, Ru) Alloy", "Tetsu-to-Hagane", vol. 80, (1994), No. 4, pp. 353-358.

* cited by examiner

*Primary Examiner* — Jessee R Roe
(74) *Attorney, Agent, or Firm* — Birch, Stewart, Kolasch & Birch, LLP

(57) ABSTRACT

To provide a titanium alloy with superior corrosion resistance. The titanium alloy, having α- and β-phases, containing: by mass %, Fe: 0.010 to 0.300%, Ru: 0.010 to 0.150%, Cr: 0 to 0.10%, Ni: 0 to 0.30%, Mo: 0 to 0.10%, Pt: 0 to 0.10%, Pd: 0 to 0.20%, Ir: 0 to 0.10%, Os: 0 to 0.10%, Rh: 0 to 0.10%, one type or two or more types of La, Ce, and Nd: 0 to 0.10% in total, one type or two or more types of Cu, Mn, Sn, and Zr: 0 to 0.20% in total, C: 0.10% or less, N: 0.05% or less, O: 0.20% or less, H: 0.100% or less, with the balance made up of Ti and impurities, wherein an average A-value in Expression (1), which represents a composition ratio of elements contained in β-phase crystal grains, is in a range of 0.550 to 2.000, is used.

1 Claim, 1 Drawing Sheet

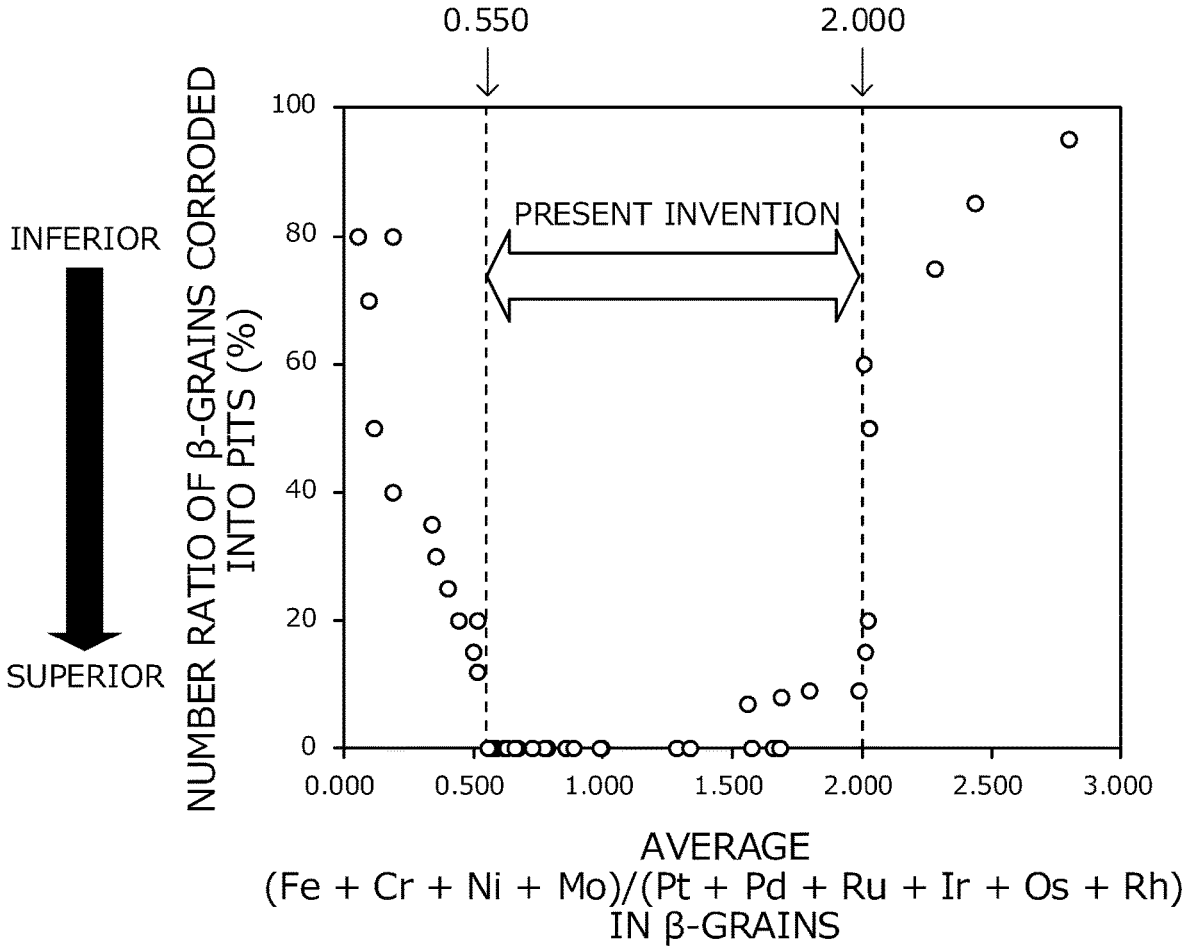
0.550
2.000
INFERIOR
SUPERIOR
PRESENT INVENTION
NUMBER RATIO OF β-GRAINS CORRODED INTO PITS (%)
100
80
60
40
20
0
0.000
0.500
1.000
1.500
2.000
2.500
3.000
AVERAGE
(Fe + Cr + Ni + Mo)/(Pt + Pd + Ru + Ir + Os + Rh)
IN β-GRAINS

TITANIUM ALLOY

TECHNICAL FIELD

The present invention relates to a titanium alloy.

BACKGROUND ART

Commercially pure titanium exhibits excellent corrosion resistance even in seawater, where general-purpose stainless steels such as SUS304 corrode. Therefore, industrial pure titanium has been used in desalination plants or the like, taking advantage of its high corrosion resistance.

On the other hand, commercially pure titanium is sometimes used as a component material for chemical plants in environments that are more corrosive than seawater, such as hydrochloric acid. In such an environment, even commercially pure titanium corrodes noticeably.

Therefore, a corrosion-resistant titanium alloy, which is superior to commercially pure titanium in corrosion resistance, has been developed for use in severe corrosive environments.

Patent Document 1 describes a titanium alloy in which platinum group elements such as Pd are added to suppress a decrease in corrosion resistance. Further, Patent Document 2 and Non-Patent Document 1 disclose a titanium alloy in which corrosion resistance is improved by precipitating intermetallic compounds in addition to the addition of platinum group elements.

However, in these conventional titanium alloys, local corrosion may occur in the intermetallic compounds, a β-phase itself, or around the intermetallic compounds or β-phase, which may cause the intermetallic compounds or β-phase to drop out. Therefore, there has been room for improvement in the decrease in the corrosion resistance of conventional titanium alloys because local corrosion of the intermetallic compounds and β-phase itself and local corrosion caused by the dropout of the intermetallic compounds and β-phase due to the local corrosion around the intermetallic compounds and β-phase occur.

As an example of attempted improvement, for example, Patent Document 3 proposes a structure of the titanium alloy in which an Ni-rich β-phase and $Ti_2Ni$ coexist.

PRIOR ART DOCUMENT

Patent Document

Patent Document 1: International Publication Pamphlet No. WO 2007/077645

Patent Document 2: Japanese Laid-open Patent Publication No. H6-25779

Patent Document 3: Japanese Laid-open Patent Publication No. 2012-12636

Non-Patent Document

Non-Patent Document 1: "Tetsu-to-Hagane", Vol. 80, No. 4 (1994), pp. 353-358

DISCLOSURE OF THE INVENTION

Problems to be Solved by the Invention

However, even if the structure as described in Patent Document 3 is formed, the titanium alloy does not exhibit sufficient local corrosion resistance compared to a level of corrosion resistance required in practical use, and there is still room for improvement in terms of improving corrosion resistance.

In view of the above, it has been long awaited to develop a titanium alloy with superior corrosion resistance by suppressing local corrosion of the intermetallic compounds and β-phase itself, and local corrosion caused by the dropout of the intermetallic compounds and β-phase due to local corrosion around the intermetallic compounds and β-phase.

The present invention was made to solve the above problems, and to provide a titanium alloy with superior corrosion resistance.

Means for Solving the Problems

To solve the above problems, the inventors studied the local corrosion of the intermetallic compounds and β-phase itself, as well as the local corrosion that occurred around the intermetallic compounds and β-phase.

As a result, it was found that a composition of the β-phase played a more important role in suppressing the occurrence of the local corrosion than the presence of the intermetallic compounds. That is, the inventors found that local corrosion could be suppressed by keeping an average (Fe+Cr+Ni+Mo)/(Pt+Pd+Ru+Ir+Os+Rh) ratio, which was a ratio of elements contained in β-phase crystal grains (hereinafter, the β-phase crystal grains are sometimes abbreviated as "β-grains"), within a range of 0.55 to 2.00.

In addition to the above findings, the inventors also found that further improvement effect in corrosion resistance could be achieved by adding a small amount of rare earth elements La, Ce, Nd, and Cu, Mn, Sn, and Zr, which acted to stabilize a passivation film, to the titanium alloy.

The gist of the present invention based on the above findings is as follows.

[1] A titanium alloy having an α-phase and a β-phase, contains, by mass %, Fe: 0.010 to 0.300%, Ru: 0.010 to 0.150%, Cr: 0 to 0.10%, Ni: 0 to 0.30%, Mo: 0 to 0.10%, Pt: 0 to 0.10%, Pd: 0 to 0.20%, Ir: 0 to 0.10%, Os: 0 to 0.10%, Rh: 0 to 0.10%, one type or two or more types of La, Ce, and Nd: 0 to 0.10% in total, one type or two or more types of Cu, Mn, Sn, and Zr: 0 to 0.20% in total, C: 0.10% or less, N: 0.05% or less, O: 0.20% or less, H: 0.100% or less, with the balance made up of Ti and impurities, wherein an average value of an A-value in Expression (1) below, which represents a composition ratio of elements contained in β-phase crystal grains, is in a range of 0.550 to 2.000.

$$A=([Fe]+[Cr]+[Ni]+[Mo])/([Pt]+[Pd]+[Ru]+[Ir]+[Os]+[Rh]) \quad (1)$$

Here, each indication of [element symbol] in Expression (1) indicates an elemental concentration (mass %) in the β-phase crystal grains.

[2] The titanium alloy according to [1], wherein an area ratio of the β-phase crystal grains is in a range of 1 to 10%, and an average crystal grain diameter of the β-phase crystal grains is in a range of 0.3 to 5.0 μm.

Effect of the Invention

According to the present invention, local corrosion of intermetallic compounds and a β-phase itself, as well as local corrosion around them, can be suppressed, and a titanium alloy with superior corrosion resistance can be provided.

BRIEF DESCRIPTION OF THE DRAWINGS

FIG. 1 is a diagram illustrating a relationship between an average (Fe+Cr+Ni+Mo)/(Pt+Pd+Ru+Ir+Os+Rh) ratio of β-phase crystal grains and a number ratio of the β-phase crystal grains corroded into pits to the total number of β-phase crystal grains in Experimental examples (No. 1-49).

EMBODIMENTS FOR CARRYING OUT THE INVENTION

A titanium alloy according to an embodiment of the present invention is described in detail below <<Titanium Alloy>>

The titanium alloy according to this embodiment is a titanium alloy having α and β, in which an α-phase is a main phase and a small amount of β-phase is dispersed in the α-phase. More in detail, the titanium alloy of this embodiment is a titanium alloy having the α-phase and the β-phase, and containing: by mass %, Fe: 0.010 to 0.300%, Ru: 0.010 to 0.150%, Cr: 0 to 0.10%, Ni: 0 to 0.30%, Mo: 0 to 0.10%, Pt: 0 to 0.10%, Pd: 0 to 0.20%, Ir: 0 to 0.10%, Os: 0 to 0.10%, Rh: 0 to 0.10%, one type or two or more types of La, Ce, and Nd: 0 to 0.10% in total, one type or two or more types of Cu, Mn, Sn and Zr: 0 to 0.20% in total, C: 0.10% or less, N: 0.05% or less, O: 0.20% or less, H: 0.100% or less, with the balance made up of Ti and impurities, wherein an average value of an A-value in Expression (1) below, which represents a component ratio of elements contained in the β-phase crystal grains, is within a range of 0.550 to 2.000. Here, each indication of [element symbol] in Expression (1) below indicates an elemental concentration (mass %) in the β-phase crystal grains.

$$A=([Fe]+[Cr]+[Ni]+[Mo])/([Pt]+[Pd]+[Ru]+[Ir]+[Os]+[Rh]) \quad (1)$$

<Chemical Composition of Titanium Alloy>

First, a chemical composition of the titanium alloy of this embodiment will be explained. In the following explanation of the chemical composition, "mass %" is simply abbreviated as "%". In addition, "XX to YY" (XX and YY indicate numerical values for content, temperature, and the like) means XX or more and YY or less.

[Ru: 0.010 to 0.150%]

Ruthenium (Ru) is an element that effectively acts to improve corrosion resistance by making corrosion potentials of the β-phase itself and a material as a whole noble due to its small hydrogen overvoltage, and by promoting passivation of titanium. An Ru content is set to 0.010% or more to achieve this effect. The Ru content is preferably 0.020% or more, and more preferably 0.025% or more. However, since Ru is a strong β-stabilizing element, the excessive Ru content may cause excessive concentration in the β-phase, resulting in an unnecessary increase in a β-phase area ratio. Besides, the excessive Ru content may also cause deviation of the (Fe+Cr+Ni+Mo)/(Pt+Pd+Ru+Ir+Os+Rh) ratio in the β-phase crystal grains from a proper balance, as described below. For this reason, the Ru content is set to 0.150% or less. The Ru content is preferably 0.130% or less, and more preferably 0.100% or less.

[Fe: 0 010 to 0.300%]

Iron (Fe) is a β-stabilizing element and is concentrated and distributed in the β-phase similarly to Ru. The hydrogen overvoltage of Fe itself is not necessarily small, and the addition of Fe alone does not improve the corrosion resistance. However, the presence of Fe together with Ru in the β-phase crystal grains brings about the effect of improving the corrosion resistance. An Fe content in the alloy is therefore set to 0.010% or more. The Fe content is preferably 0.020% or more, and more preferably 0.050% or more. On the other hand, the excessive Fe content may cause deviation of the (Fe+Cr+Ni+Mo)/(Pt+Pd+Ru+Ir+Os+Rh) ratio in the β-phase crystal grains from a proper balance, as described below. The Fe content is therefore set to 0.300% or less. The Fe content is preferably 0.250% or less, and more preferably 0.200% or less.

The titanium alloy of this embodiment may or may not contain one type or two or more types of the following elements: Cr: 0 to 0.10%, Ni: 0 to 0.30%, Mo: 0 to 0.10%, Pt: 0 to 0.10%, Pd: 0 to 0.20%, Ir: 0 to 0.10%, Os: 0 to 0.10%, Rh: 0 to 0.10%. When these elements are not contained, a lower limit value of each content is 0%.

[Cr: 0 to 0.10%]

Although a small amount of chromium (Cr) contained in the titanium alloy does not have an adverse effect on the corrosion resistance, a large amount of Cr can have an adverse effect by lowering the pH of a local anode and promoting the development of local corrosion. A Cr content is therefore set to 0.10% or less. The Cr content is preferably 0.08% or less, and more preferably 0.05% or less. On the other hand, a lower limit value of the Cr content is 0%.

[Ni: 0 to 0.30%]

Nickel (Ni) is an element for improving the corrosion resistance when contained in Ti to form intermetallic compounds. However, the formation of the intermetallic compounds may cause local corrosion, and the titanium alloy of the present invention does not necessarily actively contain Ni. An Ni content is therefore set to 0.30% or less. The Ni content is preferably 0.25% or less, and more preferably 0.09% or less. On the other hand, a lower limit value of the Ni content is 0%.

[Mo: 0 to 0.10%]

Molybdenum (Mo) is an element for improving the corrosion resistance by functioning as a corrosion inhibitor when it is eluted and ionized. However, in the present invention, which inhibits a small amount of local corrosion, Mo does not ionize to the extent of functioning as the corrosion inhibitor, and the titanium alloy of the present invention does not necessarily actively contain Mo. An Mo content is therefore set to 0.10% or less. The Mo content is preferably 0.05% or less, and more preferably 0.03% or less. On the other hand, a lower limit value of the Mo content is 0%.

[Pt: 0 to 0.10%]

Platinum (Pt) is an effective element for improving the corrosion resistance by making the corrosion potential of the β-phase itself and the material as a whole noble due to its small hydrogen overvoltage, and by promoting passivation of titanium. In the present invention, sufficient corrosion resistance can be achieved by the addition of other platinum group elements without actively containing Pt. Further, excessive content of Pt, which is an expensive rare element, causes to impair a material cost. A Pt content is therefore set to 0.10% or less. The Pt content is preferably 0.08% or less, and more preferably 0.05% or less. On the other hand, a lower limit value of the Pt content is 0%.

[Pd: 0 to 0.20%]

Palladium (Pd) is an effective element for improving the corrosion resistance in a small amount by making the corrosion potential of the β-phase itself and the material as a whole noble due to its small hydrogen overvoltage, and by promoting passivation of titanium. However, since Pd is a rare and expensive element, excessive addition of Pd may impair the material cost. A Pd content is therefore set to 0.20% or less. The Pd content is preferably 0.15% or less, and more preferably 0.10% or less. On the other hand, a lower limit value of the Pd content may be 0%, or 0.01% or more.

[Ir: 0 to 0.10% or Less]

Iridium (Ir) is an effective element for improving the corrosion resistance by making the corrosion potential of the β-phase itself and the material as a whole noble due to its small hydrogen overvoltage, and by promoting passivation of titanium. In the present invention, the sufficient corrosion resistance can be achieved by the content of other platinum group elements without actively containing Ir. On the other hand, excessive addition of Ir, which is an expensive and rare element, may cause to impair the material cost. Further, the excessive Ir content promotes the precipitation of unwanted intermetallic compounds. An Ir content is therefore set to 0.10% or less. The Ir content is preferably 0.08% or less, and more preferably 0.05% or less. On the other hand, a lower limit value of the Ir content is 0%.

[Os: 0 to 0.10%]

[Rh: 0 to 0.10%]

Osmium (Os) and rhodium (Rh) are effective elements for improving the corrosion resistance by making the corrosion potential of the β-phase itself and the material as a whole noble due to their small hydrogen overvoltage, and by promoting passivation of titanium. In the present invention, the sufficient corrosion resistance can be achieved by the content of other platinum group elements without actively containing Os and Rh. On the other hand, excessive content of Os and Rh, which are expensive and rare elements, may cause to impair the material cost. Further, the excessive content of Os and Rh can promote β-phase precipitation beyond a specified range. Os and Rh contents are each therefore set to 0.10% or less. The Os and Rh contents are each preferably 0.08% or less, and more preferably 0.06% or less. On the other hand, a lower limit value of each of the Os and Rh contents is 0%.

In the titanium alloy of this embodiment, other than the above-mentioned elements (the balance) is made up of titanium (Ti) and impurities. The "impurities" in this embodiment are components that are mixed in by various factors in a manufacturing process, including raw materials such as sponge titanium and scrap, when titanium alloys are manufactured industrially, and also include unavoidable components. Such unavoidable impurities include, for example, oxygen, hydrogen, carbon, and nitrogen. Content ratios of these elements may be limited to the extent capable of solving problems of the present invention. A permissible oxygen (O) content is 0.20% or less, a permissible hydrogen (H) content is 0.100% or less, a permissible carbon (C) content is 0.10% or less, and a permissible nitrogen (N) content is 0.05% or less. The lower the content of these elements, the better, and although no lower limit value of content is specified, it is difficult to set the content of these elements to zero.

In addition to each of the elements described above, the titanium alloy of this embodiment can contain various elements to the extent that the effect of the present invention is not impaired. Examples of such elements include, for example, aluminum (Al), vanadium (V), silicon (Si), and the like. The effect of the present invention is not impaired as long as the contents of these elements are Al: 0.10% or less, V: 0.10% or less, and Si: 0.1% or less, respectively.

<Optional Elements>

The titanium alloy of this embodiment may further contain one type or two or more types of lanthanum (La), cerium (Ce), and neodymium (Nd) in a total of 0.001 to 0.10% by mass %, and one type or two or more types of Cu, Mn, Sn, and Zr in a total of 0.01 to 0.20% by mass % in place of a part of Ti in the balance.

[Total Content of La, Ce, Nd: 0 to 0.10%]

The titanium alloy of this embodiment may contain one type or two or more types of La, Ce, and Nd. However, these elements are optional and may not be contained. In other words, a lower limit value of the content of each of La, Ce, and Nd is 0%.

The effect of improving the corrosion resistance is not sufficient only by containing La, Ce, and Nd, respectively, without containing the platinum group elements such as Ru and Pd. However, there are effects of making the passivation film made up of titanium oxides more difficult to dissolve and further improving the corrosion resistance by containing elements with low hydrogen overvoltage, such as Ru and Pd, together with La, Ce, and Nd in a total of 0.001% or more. Therefore, the lower limit value of the total content of La, Ce, and Nd may be set to 0.001% when this effect is required. However, since all of the elements La, Ce, and Nd tend to form oxides, excessive content of these elements can lead to the formation of unwanted inclusions, which is not desirable. The total content of La, Ce, and Nd is therefore set to 0.10% or less. The total content of La, Ce, and Nd is more preferably 0.080% or less. La, Ce, and Nd may be contained alone or two or more types of them may be contained. When La, Ce, and Nd are contained as a mixture, mish metal can be used.

When La is contained, a lower limit value of the La content is preferably 0.001%, for example, and more preferably 0.002%. An upper limit value of the La content is preferably 0.100%, for example, and more preferably 0.080%. When Ce is contained, a lower limit value of the Ce content is preferably 0.001%, for example, and more preferably 0.002%. An upper limit value of the Ce content is preferably 0.100%, for example, and more preferably 0.080%. When Nd is contained, a lower limit value of the Nd content is preferably 0.001%, for example, and more preferably 0.002%. An upper limit value of the Nd content is preferably 0.100%, for example, and more preferably 0.080%.

[Total Content of Cu, Mn, Sn, Zr: 0 to 0.20%]

The titanium alloy of this embodiment may contain one type or two or more types of copper (Cu), manganese (Mn), tin (Sn), and zirconium (Zr). However, these elements are optional and may not be contained. In other words, a lower limit value of the content of each of Cu, Mn, Sn, and Zr is 0%.

The effect of improving the corrosion resistance is not sufficient only by containing Cu, Mn, Sn, and Zr, respectively, without containing the platinum group elements such as Ru and Pd. However, there are effects of making the passivation film made up of titanium oxides more difficult to dissolve and further improving the corrosion resistance by containing elements with low hydrogen overvoltage, such as Ru and Pd, together with Cu, Mn, Sn, and Zr in a total of 0.01% or more. However, the effect of improving the corrosion resistance per atom is weaker than that of La, Ce, and Nd. A lower limit value of the total content of Cu, Mn, Sn, and Zr may be set to 0.01% when these effects are required. Cu, Mn, Sn, and Zr can be contained in relatively large amounts since they do not tend to form oxides. However, it is not desirable to contain excessive amounts of these elements because they form a metal structure such as $Ti_2Cu$, which is not necessary for the present invention. The total content of Cu, Mn, Sn, and Zr is therefore set to 0.20% or less. The total content of Cu, Mn, Sn, and Zr is preferably 0.10% or less, and more preferably 0.008% or less. Cu, Mn, Sn, and Zr may be contained alone, or two or more types of them may be contained.

When Cu is contained, a lower limit value of the Cu content is preferably 0.01%, for example, and more preferably 0.02%. An upper limit value of the Cu content is preferably 0.20%, for example, and more preferably 0.10%. When Mn is contained, a lower limit value of the Mn content is preferably 0.01%, for example, and more preferably 0.02%. An upper limit value of the Mn content is preferably 0.20%, for example, and more preferably 0.10%. When Sn is contained, a lower limit value of the Sn content is preferably 0.01%, for example, and more preferably 0.02%. An upper limit value of the Sn content is preferably 0.20%, for example, and more preferably 0.10%. When Zr is contained, a lower limit value of the Zr content is preferably 0.01%, for example, and more preferably 0.02%. An upper limit value of the Zr content is preferably 0.20%, for example, and more preferably 0.10%.

The chemical composition of the titanium alloy of this embodiment was described in detail above.

<Elemental Concentration in β-Phase Crystal Grains>

Next, an elemental concentration in the β-phase crystal grains is explained. As mentioned earlier, the titanium alloy of this embodiment has a structure in which fine β-phase crystal grains are dispersed in an α-phase structure. In the titanium alloy of this embodiment, two phases, the α-phase and the β-phase, are present, and a ratio of elements that contribute to making the corrosion potential noble, such as Ru, to other elements among the elements concentrated in the β-phase is kept within a proper range. This balances the corrosion potential of the α-phase and that of the β-phase, thereby improving the local corrosion resistance.

In explaining the titanium alloy of this embodiment, the inventors broadly categorized the above mentioned β-stabilizing elements into two groups: one element group that contributes to making the corrosion potential of the β-phase noble with small hydrogen overvoltage, and the other element group that does not contribute to making the corrosion potential of the β-phase noble with large hydrogen overvoltage. The element group that contributes to making the corrosion potential of the β-phase noble with small hydrogen overvoltage includes the platinum group elements including Ru (that is, Ru, Pt, Pd, Ir, Os, and Rh), and the element group that does not contribute to making the corrosion potential of the β-phase noble with large hydrogen overvoltage includes Fe, Cr, Ni, and Mo. In the titanium alloy of this embodiment, the corrosion potential of the α-phase and that of the β-phase are adjusted by the contents of these two element groups.

Mainly the β-stabilizing elements and the platinum group elements are concentrated in the β-phase crystal grains of the titanium alloy of this embodiment, and when a component ratio of the elements concentrated in the β-phase crystal grains is in a predetermined range, the alloy will be able to exhibit superior corrosion resistance. Concretely, an average value of an A-value in Expression (1) below, which represents the component ratio of the elements contained in the β-phase crystal grains, needs to meet a range of 0.550 to 2.000.

$$A=([Fe]+[Cr]+[Ni]+[Mo])/([Pt]+[Pd]+[Ru]+[Ir]+[Os]+[Rh]) \quad (1)$$

Here, each indication of [element symbol] in Expression (1) indicates an elemental concentration (mass %) in the β-phase crystal grains. For the element in Expression (1) that is not contained in the β-phase crystal grains, zero is substituted in a term of [element symbol] of the element concerned.

The average (Fe+Cr+Ni+Mo)/(Pt+Pd+Ru+Ir+Os+Rh) ratio in the β-phase crystal grains (hereinafter, sometimes abbreviated as "(β-grains") is set within the range of 0.550 to 2.000 to provide the titanium alloy with superior corrosion resistance by suppressing the local corrosion. By satisfying conditions related to this ratio, a composition in the β-grains can balance the corrosion potential of the α-phase and that of the β-phase. As a result, the β-phase and an area around the β-phase do not become preferential corrosion sites, and local corrosion is suppressed, resulting in the superior corrosion resistance.

As mentioned earlier, it is important to balance between the platinum group elements such as Pt, Pd, Ru, Ir, Os, and Rh, which have low hydrogen overvoltages, and the other β-stabilizing elements, which have higher hydrogen overvoltages than the platinum group elements to avoid the β-phase and the area around the β-phase becoming preferential corrosion sites in the composition of the β-grains. As an index to express this suitable balance, the value of the (Fe+Cr+Ni+Mo)/(Pt+Pd+Ru+Ir+Os+Rh) ratio in the β-grains is specified as the A-value, and the average value of this A-value is set to be within the range of 0.550 to 2.000.

When there are many platinum group elements distributed in the β-grains, that is, when the average (Fe+Cr+Ni+Mo)/(Pt+Pd+Ru+Ir+Os+Rh) ratio is small to be less than 0.550, the β-phase is not preferentially dissolved, but the local corrosion occurs around the β-phase. Therefore, in the titanium alloy of this embodiment, the average (Fe+Cr+Ni+Mo)/(Pt+Pd+Ru+Ir+Os+Rh) ratio in the β-grains is set to be 0.550 or more. In the titanium alloy of this embodiment, the value of the average (Fe+Cr+Ni+Mo)/(Pt+Pd+Ru+Ir+Os+Rh) ratio in the β-grains is preferably 0.600 or more, and more preferably 0.650 or more. On the other hand, when there are few platinum group elements distributed in the β-grains, that is, when the average (Fe+Cr+Ni+Mo)/(Pt+Pd+Ru+Ir+Os+Rh) ratio is large to be over 2.000, the β-phase becomes the preferential corrosion site and the local corrosion occurs. Therefore, in the titanium alloy of this embodiment, the average (Fe+Cr+Ni+Mo)/(Pt+Pd+Ru+Ir+Os+Rh) ratio in the β-grains is set to be 2.000 or less. In the titanium alloy of this embodiment, the value of the average (Fe+Cr+Ni+Mo)/(Pt+Pd+Ru+Ir+Os+Rh) ratio in the β-grains is preferably 1.800 or less, and more preferably 1.500 or less. Thus, as the range capable of suppressing the local corrosion occurring at both the β-phase and around the β-phase, the average (Fe+Cr+Ni+Mo)/(Pt+Pd+Ru+Ir+Os+Rh) ratio in the β-grains is set within the range of 0.550 to 2.000 in the titanium alloy of this embodiment. Control of the average (Fe+Cr+Ni+Mo)/(Pt+Pd+Ru+Ir+Os+Rh) ratio in the β-grains within the proper range can be achieved by adjusting a cooling rate after finish annealing, which will be described later.

The average (Fe+Cr+Ni+Mo)/(Pt+Pd+Ru+Ir+0 s+Rh) ratio in the β-grains can be determined as follows.

A surface of the titanium alloy is ground to several tens μm, and then mechanically polished using a colloidal silica-containing liquid as a polishing liquid. Then, the surface after polishing is subjected to elemental analysis by an EPMA (electron probe micro analyzer). Concretely, an enlarged image of the surface magnified 3000 times is used to identify the β-grains in a region of approximately 30 μm×30 μm, for example. In this case, the β-grains with an average grain diameter of 0.5 μm or more are targets for identification. From among the identified β-grains, 10 grains are selected in descending order of grain diameter, and a chemical composition of each of these 10 β-grains is analyzed by the EPMA method. The elements to be measured by the EPMA method are Fe, Ru, Cr, Ni, Mo, Pt, Pd, Ir, Os, Rh, and Ti. The mass % of each element to be measured in the β-grains is determined for one field of view to be measured. By substituting an obtained content ratio of each element into Expression (1), the (Fe+Cr+Ni+Mo)/(Pt+Pd+Ru+Ir+Os+Rh) ratio is determined for each of the 10 β-grains to be measured. These ratios are then averaged to obtain the average (Fe+Cr+Ni+Mo)/(Pt+Pd+Ru+Ir+Os+Rh) ratio in the β-grains. The measurement is carried out for any 10 fields of view, and the average (Fe+Cr+Ni+Mo)/(Pt+Pd+Ru+Ir+Os+Rh) ratio obtained in each field of view is used to calculate an arithmetic average for the number of fields of view. The obtained arithmetic average value is used as the average (Fe+Cr+Ni+Mo)/(Pt+Pd+Ru+Ir+Os+Rh) ratio in the β-grains. In the EPMA method, an acceleration voltage is set to 5 to 20 KeV. By performing the EPMA measurement under such conditions, it is possible to perform point analysis on an area where one point is about 0.2 to 1.0 μm, and such a point analysis is performed over the entire measurement field of view to be focused on.

<Metal Structure of Titanium Alloy>

As mentioned earlier, the titanium alloy of this embodiment has a metal structure in which there are two phases, the α-phase and the β-phase, in which the α-phase is a main phase and a small amount of β-phase is dispersed in the α-phase. Here, the α-phase being the main phase means that an area ratio of the α-phase is more than 90%.

An average grain diameter of α-phase crystal grains of the titanium alloy of this embodiment (hereinafter, sometimes abbreviated as "α-grains") is 5 to 80 μm. When a value obtained by dividing a length of a major axis of the crystal grain by a length of a minor axis is used as an aspect ratio, the α-phase of the titanium alloy of this embodiment is characterized in that the average aspect ratio of the α-grains is in a range of 0.5 to 2.0 and the α-grains with the aspect ratio of 4 or more are contained 10% or more in a number ratio of grains. The presence of such α-grains with different aspect ratios is not essential, but their presence has an advantage of enabling processing without cracking or the like when local elongation occurs and deformation corresponding to local elongation is applied.

The β-phase of the titanium alloy of this embodiment is characterized in that an area ratio is in a range of 1 to 10%, the average grain diameter of the β-phase crystal grains is in a range of 0.3 to 5.0 μm, and the average (Fe+Cr+Ni+Mo)/(Pt+Pd+Ru+Ir+Os+Rh) ratio in the β-phase crystal grains is in the range of 0.550 to 2.000.

When the area ratio of the β-phase is too small, the corrosion progress of one pit becomes deeper even if a number ratio of pit-like corrosion is small, which is not desirable. This phenomenon is more pronounced when the area ratio of the β-phase is less than 1%. The area ratio of the β-phase is therefore preferably set to 1% or more, and more preferably 3% or more. On the other hand, when the area ratio of the β-phase is too large, the pits will be connected to form large pits due to the progress of corrosion even if the number ratio of the pit-like corrosion is small, which is not desirable. This phenomenon is more pronounced when the area ratio of the β-phase exceeds 10%. The area ratio of the β-phase is therefore preferably set to 10% or less, and more preferably 8% or less.

When the average grain diameter of the β-grains is too small or too large, the percentage of the β-phase that does not satisfy the average (Fe+Cr+Ni+Mo)/(Pt+Pd+Ru+Ir+Os+Rh) ratio in the β-grains may increase relatively. This phenomenon is more pronounced when the average grain diameter of the β-grains is less than 0.3 μm or over 5.0 μm. The average grain diameter of the β-grains is preferably between 0.3 and 5.0 μm. The average grain diameter of the β-grains is more preferably 0.5 μm or more, and 4.0 μm or less.

The area ratio, average grain diameter, shape, and the like of the α-phase and β-phase as described above can be identified by the following methods.

To identify the average grain diameter and shape of the α-phase, an L- and T-cross sections of a material are mirror polished and then etched using a mixed solution of a hydrogen fluoride aqueous solution and a nitric acid aqueous solution in an arbitrary ratio to reveal grain boundaries. The α-phase is observed as white under an optical microscope, while the β-phase and grain boundaries are observed as black by this etching.

Then, observation is performed with an optical microscope at a magnification of 200 to 500 times to observe the grain diameter and the grain shape. The average grain diameter and the aspect ratio of the α-grains are measured from the results of the observation of 10 or more fields of view. A cutting method specified in JIS G 551 is used. For the measurement of the average grain diameter of the α-grains, a straight line of known length (length: Lα) is drawn arbitrarily in L, T, and thickness directions of the observed optical microscope image, and the number of α-grain boundaries crossed by the straight line is counted (the number of α-grain boundaries crossed: Nα). A value obtained by dividing the length Lα by the number of α-grain boundaries crossed, Nα, is the α-grain diameter. Three or more straight lines are drawn in the L, T, and thickness directions, respectively, to measure the α-grain diameter in the same way. An arithmetic average of the measured α-grain diameters is used as the average grain diameter of the α-grains. The aspect ratio is also measured in the same way. That is, a straight line of known length is drawn in each of a direction parallel to a major axis and a direction parallel to a minor axis of the α-phase crystal grain, the number of α-grain boundaries crossed by each line is counted, and the aspect ratio is measured by dividing these numbers.

The average grain diameter and area ratio of the β-phase are observed using an electron microscope at a magnification of 1000 to 3000 times because of the small size of the β-phase. The average grain diameter of the β-grains is measured in the same way as the average grain diameter of the α-grains. A straight line of known length (length: Lβ) is drawn arbitrarily in L, T, and thickness directions of the observed electron microscope image, and the number of β-grain boundaries crossed by the straight line is counted (the number of β-grain boundaries crossed: Nβ). A value obtained by dividing the length Lβ by the number of β-grain boundaries crossed, Nβ, is the β-grain diameter. Three or more straight lines are drawn in the L, T, and thickness directions, respectively, to measure the β-grain diameter in the same way. An arithmetic average of the measured β-grain diameters is used as the average grain diameter of the β-grains (dβ). The area ratio of the β-phase is determined by measuring the number of β-grains (Pβ) present in the field of view from the electron microscope image, multiplying the average grain diameter of the β-grains (dβ) by the number of β-grains present in the field of view, and dividing this product by an area of the entire observation area.

<<Manufacturing Method of Titanium Alloy>>

Next, an example of a manufacturing method for the titanium alloy of this embodiment will be explained. The manufacturing method explained below is an example to obtain the titanium alloy according to this embodiment of the present invention, and the titanium alloy according to the embodiment of the present invention is not limited to the following manufacturing method.

As described above, the titanium alloy targeted in this embodiment is applied as a hot-rolled sheet or cold-rolled sheet. These rolled sheets are then subjected to finish annealing and made into products.

When the β-phase is finely precipitated in a normal manufacturing method of a titanium alloy, the corrosion potential of the β-phase becomes lower because of a high Fe content in the β-phase, and the β-phase is more easily corroded than the α-phase. As a result, the surface of the titanium alloy becomes rough. This kind of surface roughness should be avoided in applications that require surface cleanliness. The manufacturing method of titanium alloy of this embodiment provides a titanium alloy with superior corrosion resistance while suppressing the above-mentioned decrease in the surface cleanliness.

In the following, Ru is focused as an element that contributes to making the corrosion potential of the β-phase noble with a small hydrogen overvoltage, and Fe is focused as an element that does not contribute to making the corrosion potential of the β-phase noble with a large hydrogen overvoltage to briefly explain a phenomenon of Ru concentration in the β-grains enabled by the manufacturing method of the titanium alloy of this embodiment.

The manufacturing method of the titanium alloy of this embodiment adjusts a balance of Fe and Ru in the β-phase by concentrating Ru into the β-phase in an α+β two-phase region or an α single-phase region and subsequent cooling, during the finish annealing. That is, in these temperature regions, Fe has a fast diffusion rate and tends to move from the β-phase to the α-phase, while Ru has a slow diffusion rate and tends to remain in the β-phase. By taking advantage of this difference in diffusion rates between Ru and Fe, and by appropriately adjusting a cooling rate, the manufacturing method of the titanium alloy of this embodiment allows Fe and Ru to solid-solve in the β-phase in an appropriate ratio, so that the average value of the A-value expressed in Expression (1) above is within a desired range. Such a degree of concentration of Ru in the β-phase depends on the cooling rate. For this reason, it is important to control conditions of this finish annealing in the manufacturing method of the titanium alloy of this embodiment.

The following explains a suitable manufacturing method of the titanium alloy of this embodiment.

The titanium alloy of this embodiment is manufactured by sequentially performing a first process of annealing a plasticized titanium alloy material at a finish annealing temperature: 550 to 780° C. and a finish annealing time: 1 minute to 70 hours, and a second process of cooling the material under a condition that an average cooling rate from the finish annealing temperature to reach 400° C. is 0.20° C./s or less. For example, a hot-rolled sheet or a cold-rolled sheet can be used as the plasticized titanium alloy material.

Each process is explained below.

First, ingots or slabs having the above chemical composition are cast, and then subjected to hot-working, such as hot-forging or hot-rolling, and descaling, followed by cold-working as necessary. In this way, the titanium alloy material is manufactured. The titanium alloy material is not limited to the material after the cold-working but may be the material after the hot-working, or after the hot-working and descaling.

Next, the titanium alloy material is subjected to the finish annealing as the first process. After the finish annealing, the descaling is performed as necessary.

The finish annealing temperature is set to be in the range of 550 to 780° C. as described above. A heating rate to the finish annealing temperature is set to 0.001 to 10.000° C./s. The heating rate to the finish annealing temperature is defined as a value obtained by dividing a temperature rise range of a surface of the titanium alloy material from (temperature rise start temperature+10)° C. to a target value of the finish annealing temperature by the time required from the (temperature rise start temperature+10)° C. to the target value of the finish annealing temperature.

When the finish annealing temperature is less than 550° C., un-recrystallized grains remain in a structure to deteriorate workability, which is not desirable. The finish annealing temperature is preferably 580° C. or more, and more preferably 600° C. or more. On the other hand, when the finish annealing temperature exceeds 780° C., a surface form and shape of the material become poor, which is not desirable. The finish annealing temperature is preferably 750° C. or less, and more preferably 700° C. or less.

When the heating rate to the finish annealing temperature is less than 0.001° C./s, the annealing requires unnecessary time to impair production efficiency, which is not desirable. The heating rate to the finish annealing temperature is preferably 0.005° C./s or more, and more preferably 0.010° C./s or more. On the other hand, when the heating rate to the finish annealing temperature exceeds 10.000° C./s, the heating rate is too fast, which causes a difference in thermal history between locations such as a surface and a center of a sheet thickness, resulting in variations in the structure throughout the material to cause unstable quality, which is not desirable. The heating rate to the finish annealing temperature is preferably 8.000° C./s or less, and more preferably 5.000° C./s or less.

The finish annealing time (that is, a holding time of the finish annealing temperature) is set to be within the range of 1 minute to 70 hours, as described above, and can be set according to an annealing method employed. For example, in the case of continuous annealing, the finish annealing time can be 1 to 20 minutes, and in the case of batch annealing, the finish annealing time can be 2 to 70 hours. Considering diffusion rates of additive elements related to Expression (1) above, such as Ru and Fe, the finish annealing time is preferably 2 minutes or more in the case of the continuous annealing, and 3 hours or more in the case of the batch annealing. On the other hand, since a longer annealing time impairs production efficiency, the finish annealing time is preferably 10 minutes or less in the case of the continuous annealing and 100 hours or less in the case of the batch annealing.

An atmosphere for the finish annealing is not particularly limited, and the finish annealing may be conducted in an atmospheric atmosphere, or a vacuum or inert gas atmosphere.

Next, the titanium alloy material after heat treatment at the finish annealing temperature described above is cooled to the room temperature as the second process. As explained earlier, the cooling rate has a significant effect on the composition of the β-grains. It is necessary to achieve an appropriate composition in the β-grains to provide a titanium alloy with superior corrosion resistance. Concretely, the average (Fe+Cr+Ni+Mo)/(Pt+Pd+Ru+Ir+Os+Rh) ratio in the β-grains needs to be within the proper range as described above. In the manufacturing method of the titanium alloy of this embodiment, the average cooling rate in the temperature range from the aforementioned finish annealing temperature to 400° C. is set to 0.20° C./s or less to make the average (Fe+Cr+Ni+Mo)/(Pt+Pd+Ru+Ir+Os+

Rh) ratio in the β-grains within the desired range. By slowing down the average cooling rate in the temperature range to 0.20° C./s or less, the average (Fe+Cr+Ni+Mo)/(Pt+Pd+Ru+Ir+Os+Rh) ratio in the β-grains can be set to the proper range. The average cooling rate in the temperature range from the finish annealing temperature to 400° C. is preferably 0.150° C./s or less, and more preferably 0.120° C./s or less. On the other hand, when the average cooling rate is too slow, productivity will be reduced, so a lower limit should be set to a level that does not impair the productivity. For example, the average cooling rate can be set to 0.001° C./s or more. The average cooling rate in the temperature range from the finish annealing temperature to 400° C. is preferably 0.003° C./s or more, and more preferably 0.005° C./s or more.

The average cooling rate in the temperature range from the finish annealing temperature to 400° C. is defined as a value obtained by dividing a temperature drop range of the surface of the titanium alloy material from the finish annealing temperature to 400° C. by the time required from the finish annealing temperature to 400° C.

There is no need to limit the average cooling rate after cooling to 400° C., and cooling may be performed rapidly by water cooling or other means.

As explained above, the titanium alloy of this embodiment can avoid the β-phase and the area around the β-phase from becoming preferential corrosion sites and can suppress the local corrosion by controlling the value of the average (Fe+Cr+Ni+Mo)/(Pt+Pd+Ru+Ir+Os+Rh) ratio in the β-grains within the proper range. As a result, the titanium alloy of this embodiment can further improve the corrosion resistance even if the amount of rare elements added is small.

Examples

The present invention is explained in more detail with examples and comparative examples below. The present invention is not limited by the following examples but can be implemented with appropriate changes to the extent that it may conform to the purpose of the present invention, and such changed examples are also included in the technical scope of the present invention.

Titanium ingots with respective chemical compositions listed in Table 1 were cast by a vacuum arc melting furnace using sponge titanium, scrap, and prescribed additive elements as melting raw materials. Here, the titanium ingots were cast using the vacuum arc melting furnace, but the casting method is not limited thereto; the titanium ingots may also be cast using an electron beam melting furnace.

Underlined values in Table 1 indicate that the values are outside the range of the present invention, and a symbol "-" indicates that the element with the symbol has not been intentionally added.

The cast titanium ingots were forged and hot-rolled at a heating temperature of about 800 to 1000° C. to obtain hot-rolled sheets with a thickness of 4.0 mm. After descaling the hot-rolled sheets, they were cold-rolled to a predetermined thickness and used as titanium alloy materials.

Then, finish annealing was applied in a vacuum atmosphere with a pressure of $1.3\times10^{-4}$ Pa, followed by cooling. Conditions for the finish annealing and cooling were as listed in Table 2. The cooling rates listed in Table 2 are each the average cooling rate from the finish annealing temperature to reach 400° C. In this way, titanium alloy sheets were obtained. The holding time (annealing time) in the finish annealing was set to each time listed in Table 2 below.

Test pieces were machined from the manufactured titanium alloy sheets, and the following structure observations, elemental distribution analysis in the β-grains, and corrosion resistance tests were conducted.

For the structure observation, a surface of the prepared titanium alloy material was observed using SEM, for example, at a magnification of 3000 times or more, within a range of 30 μm×30 μm or less, to check the presence of intermetallic compounds and inclusions. Here, all structures other than the α-phase and β-grains were determined to be the intermetallic compounds or inclusions. It was determined that there were no intermetallic compounds or inclusions when a total area ratio of the intermetallic compounds or inclusions was 1% or less.

The elemental distribution analysis in the β-grains was performed as follows.

First, the surface of the titanium alloy sheet was ground to a few μm, and then mechanically polished using a colloidal silica-containing liquid as a polishing liquid. Then, the polished surface was subjected to elemental analysis by the EPMA. Concretely, the β-grains were identified in an enlarged image of the surface magnified 3000 times. The β-grains with the average grain diameter of 0.3 μm or more were selected for identification. Ten of the identified β-grains were selected in descending order from the largest grain diameter, and a chemical composition of these ten β-grains was analyzed by the EPMA method. The elements to be measured by the EPMA method were Fe, Ru, Cr, Ni, Mo, Pt, Pd, Ir, Os, Rh, and Ti. Mass % of each element to be measured in the β-grains was determined for one field of view to be measured. By substituting the obtained content of each element into the following expression, the (Fe+Cr+Ni+Mo)/(Pt+Pd+Ru+Ir+Os+Rh) ratio was determined for each of the 10 β-grains to be measured. These ratios were then averaged to determine the average (Fe+Cr+Ni+Mo)/(Pt+Pd+Ru+Ir+Os+Rh) ratio in the β-grains. The above measurements were carried out for three arbitrary fields of view, and the average (Fe+Cr+Ni+Mo)/(Pt+Pd+Ru+Ir+Os+Rh) ratio obtained for each field of view was used to calculate an arithmetic average for the number of fields of view. The obtained arithmetic average value was used as the average ((Fe+Cr+Ni+Mo)/(Pt+Pd+Ru+Ir+Os+Rh) ratio in the β-grains. In the EPMA method, the measurement was carried out at an acceleration voltage of 15 KeV.

The corrosion resistance was evaluated as follows.

A test piece (10 mm×40 mm) was cut out from the obtained titanium alloy sheet, and the test piece was immersed in 8 mass % hydrochloric acid aqueous solution at 90° C. for 24 hours to determine a corrosion rate (mm/year) calculated from a change in mass (corrosion loss) before and after the immersion. A corrosion thickness loss (thickness) was calculated from the corrosion loss (mass), and this corrosion thickness loss over 24 hours was converted to a corrosion rate per year. In other words, the unit of the corrosion rate was converted to an amount of decrease in thickness of the test piece per year. The corrosion rate was evaluated as rejected when it exceeded 0.20 (mm/year), and as accepted when it was 0.20 (mm/year) or less.

Furthermore, the test pieces after the above corrosion test were observed under a scanning electron microscope, and the number of β-grains corroded into pits was counted and divided by the total number of β-grains to measure a number ratio of the β-grains corroded into pits. Observations with the scanning electron microscope were carried out at a magnification of 3000 times, and 10 or more fields of view were observed. A recessed structure with an erosion depth of half or more of the β-grain diameter based on a non-eroded area was judged to be a pit. The local corrosion was evaluated as rejected when the number ratio of the β-grains corroded into pits exceeded 10%, and as accepted when the number ratio was within 10%.

The results obtained were summarized in Table 3 below. Underlined values in Table 3 indicate that the values are outside the range of the present invention.

FIG. 1 illustrates a relationship between the average (Fe+Cr+Ni+Mo)/(Pt+Pd+Ru+Ir+Os+Rh) ratio in the β-grains and the number ratio of the β-grains corroded into pits to the total number of β-grains in Experimental examples (No. 1 to 49).

No. 1 to 30 exhibited excellent corrosion rates, the number ratio of the β-grains corroded into pits was within 10% and the local corrosion could be suppressed because all of the chemical composition of the titanium alloy, various conditions for the finish annealing, and the average (Fe+Cr+Ni+Mo)/(Pt+Pd+Ru+Ir+Os+Rh) ratio in the β-grains specified in the present invention were satisfied. The corrosion rates of No. 1 to No. 30 were all 0.10 (mm/year) or less, which was much lower than acceptance criteria.

On the other hand, in No. 31 to 33, although the chemical composition of the titanium alloy satisfied the composition range specified in the present invention, the cooling rate after the finish annealing was too fast. Therefore, the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

The Fe content of No. 34 was excessive. Therefore, even if the various conditions for the finish annealing were appropriate, intermetallic compounds or inclusions precipitated, and the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Cr amount of No. 35 was excessive. Therefore, even if the various conditions for the finish annealing were appropriate, the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Ni content of No. 36 was excessive. Therefore, even if the various conditions for the finish annealing were appropriate, intermetallic compounds or inclusions precipitated, and the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Ru content of No. 37 was excessive. Therefore, even if the various conditions for the finish annealing were appropriate, the average (Fe+Cr+Ni+Mo)/(Pt+Pd+Ru+Ir+Os+Rh) ratio in the β-grains was below the lower limit to cause the local corrosion, resulting in the inferior corrosion resistance.

The Pd amount of No. 38 was excessive. Therefore, even if the various conditions for the finish annealing were appropriate, the average (Fe+Cr+Ni+Mo)/(Pt+Pd+Ru+Ir+Os+Rh) ratio in the β-grains was below the lower limit to cause the local corrosion, resulting in the inferior corrosion resistance.

The Ru content of No. 39 was insufficient. Therefore, even if the various conditions for the finish annealing were appropriate, the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Rh content of No. 40 was excessive. Therefore, even if the various conditions for the finish annealing were appropriate, the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

The total content of La, Ce, and Nd of No. 41 was excessive. Therefore, even if the various conditions for the finish annealing were appropriate, intermetallic compounds or inclusions precipitated, and the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

The total content of Cu, Mn, Sn, and Zr of No. 42 was excessive. Therefore, even if the various conditions for the finish annealing were appropriate, the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Mo content of No. 43 was excessive. Therefore, even if the various conditions for the finish annealing were appropriate, the average (Fe+Cr+Ni+Mo)/(Pt+Pd+Ru+Ir+Os+Rh) ratio in the β-grains exceeded the upper limit to cause the large corrosion rate and the local corrosion, resulting in the inferior corrosion resistance.

The Ir content of No. 44 was excessive. Therefore, even if the various conditions for the finish annealing were appropriate, intermetallic compounds or inclusions precipitated, and the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

The Os content of No. 45 was excessive. Therefore, even if the various conditions for the finish annealing were appropriate, the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

In No. 46, although the chemical composition of the titanium alloy satisfied the composition range specified in the present invention, the heating rate during the finish annealing was too fast. As a result, the average (Fe+Cr+Ni+Mo)/(Pt+Pd+Ru+Ir+Os+Rh) ratio in the β-grains was below the lower limit to cause the local corrosion, resulting in the inferior corrosion resistance.

In No. 47, although the chemical composition of the titanium alloy satisfied the composition range specified in the present invention, the finish annealing temperature was too low. As a result, the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

In No. 48, although the chemical composition of the titanium alloy satisfied the composition range specified in the present invention, the finish annealing temperature was too high. As a result, the average (Fe+Cr+Ni+Mo)/(Pt+Pd+Ru+Ir+Os+Rh) ratio in the β-grains exceeded the upper limit to cause the local corrosion, resulting in the inferior corrosion resistance.

In No. 49, although the chemical composition of the titanium alloy satisfied the composition range specified in the present invention, the holding time in the finish annealing was too short. As a result, the average (Fe+Cr+Ni+Mo)/(Pt+Pd+Ru+Ir+Os+Rh) ratio in the β-grains was below the lower limit to cause the large corrosion rate and the local corrosion, resulting in the inferior corrosion resistance.

TABLE 1

| | MATERIAL | CHEMICAL COMPOSITION (MASS %) BALANCE: IMPURITIES | | | | | | | | | | | | |
|---|---|---|---|---|---|---|---|---|---|---|---|---|---|---|
| | | Fe | Cr | Ni | Mo | Pd | Ru | Pt | Rh | Ir | Os | La | Ce | Nd |
| EXAMPLE | a | 0.298 | — | — | — | — | 0.031 | — | — | — | — | — | — | — |
| | b | 0.280 | — | — | — | — | 0.113 | — | — | — | — | — | — | — |
| | c | 0.236 | 0.07 | — | — | — | 0.013 | — | — | — | — | — | — | — |
| | d | 0.215 | — | 0.11 | — | — | 0.087 | — | — | — | — | — | — | — |
| | e | 0.189 | — | — | 0.09 | — | 0.143 | — | — | — | — | — | — | — |
| | f | 0.053 | — | — | — | — | 0.150 | — | — | — | — | — | — | — |
| | g | 0.230 | — | — | — | 0.11 | 0.150 | — | — | — | — | — | — | — |
| | h | 0.064 | — | — | — | — | 0.046 | 0.02 | — | — | — | — | — | — |
| | i | 0.248 | — | — | — | — | 0.082 | — | — | 0.02 | — | — | — | — |
| | j | 0.171 | — | — | — | — | 0.139 | — | — | — | 0.02 | — | — | — |
| | k | 0.089 | — | — | — | — | 0.054 | — | — | — | — | 0.01 | 0.01 | — |
| | l | 0.053 | — | — | — | — | 0.050 | — | — | — | — | 0.01 | — | — |
| | m | 0.104 | — | — | — | — | 0.106 | — | — | — | — | 0.01 | 0.01 | 0.01 |
| | n | 0.010 | — | — | — | — | 0.133 | — | 0.01 | — | — | — | — | — |
| | o | 0.215 | — | — | — | — | 0.059 | — | — | — | — | — | — | — |
| | p | 0.225 | — | 0.08 | — | — | 0.029 | — | — | — | — | — | — | — |
| | q | 0.026 | — | — | — | — | 0.015 | — | — | — | — | 0.05 | 0.03 | 0.02 |
| | r | 0.243 | — | — | — | — | 0.076 | — | — | — | — | — | — | — |
| | s | 0.090 | — | — | — | — | 0.034 | — | — | — | — | — | — | — |
| | t | 0.052 | — | — | — | — | 0.043 | — | — | — | — | — | — | — |
| | u | 0.212 | — | — | — | — | 0.138 | — | — | — | — | — | — | — |
| | v | 0.160 | — | — | — | — | 0.111 | — | — | — | — | — | — | — |
| COMPARATIVE EXAMPLE | w | 0.440 | — | — | — | — | 0.132 | — | — | — | — | — | — | — |
| | x | 0.067 | 0.19 | — | — | — | 0.094 | — | — | — | — | — | — | — |
| | y | 0.296 | — | 0.34 | — | — | 0.054 | — | — | — | — | — | — | — |
| | z | 0.232 | — | — | — | — | 0.250 | — | — | — | — | — | — | — |
| | 2a | 0.122 | — | — | — | 0.22 | 0.121 | — | — | — | — | — | — | — |
| | 2b | 0.091 | — | — | — | — | 0.008 | — | — | — | — | — | — | — |
| | 2c | 0.288 | — | — | — | — | 0.125 | — | 0.15 | — | — | — | — | — |
| | 2d | 0.264 | — | — | — | — | 0.104 | — | — | — | — | 0.07 | 0.05 | 0.02 |
| | 2e | 0.150 | — | — | — | — | 0.129 | — | — | — | — | — | — | — |
| | 2f | 0.234 | — | — | 0.12 | — | 0.066 | — | — | — | — | — | — | — |
| | 2g | 0.181 | — | — | — | — | 0.063 | — | — | 0.15 | — | — | — | — |
| | 2h | 0.181 | — | — | — | — | 0.134 | — | — | — | 0.15 | — | — | — |

| | MATERIAL | CHEMICAL COMPOSITION (MASS %) BALANCE: IMPURITIES | | | | | | | | | | |
|---|---|---|---|---|---|---|---|---|---|---|---|---|
| | | La + Ce + Nd | Cu | Mn | Sn | Zr | Cu + Mn + Sn + Zr | C | N | O | H | Ti |
| EXAMPLE | a | — | — | — | — | — | — | 0.05 | 0.05 | 0.03 | 0.019 | bal. |
| | b | — | — | — | — | — | — | 0.06 | 0.03 | 0.03 | 0.062 | bal. |
| | c | — | — | — | — | — | — | 0.05 | 0.04 | 0.09 | 0.001 | bal. |
| | d | — | — | — | — | — | — | 0.07 | 0.01 | 0.02 | 0.048 | bal. |
| | e | — | — | — | — | — | — | 0.07 | 0.03 | 0.01 | 0.020 | bal. |
| | f | — | — | — | — | — | — | 0.07 | 0.02 | 0.09 | 0.079 | bal. |
| | g | — | — | — | — | — | — | 0.09 | 0.01 | 0.02 | 0.019 | bal. |
| | h | — | — | — | — | — | — | 0.09 | 0.04 | 0.08 | 0.028 | bal. |
| | i | — | — | — | — | — | — | 0.05 | 0.01 | 0.08 | 0.090 | bal. |
| | j | — | — | — | — | — | — | 0.01 | 0.04 | 0.03 | 0.024 | bal. |
| | k | 0.02 | — | — | — | — | — | 0.03 | 0.05 | 0.05 | 0.011 | bal. |
| | l | 0.01 | — | — | — | — | — | 0.09 | 0.03 | 0.07 | 0.005 | bal. |
| | m | 0.03 | — | — | — | — | — | 0.09 | 0.05 | 0.02 | 0.016 | bal. |
| | n | — | — | — | — | — | — | 0.09 | 0.01 | 0.02 | 0.028 | bal. |
| | o | — | — | — | — | — | — | 0.05 | 0.04 | 0.01 | 0.022 | bal. |
| | p | — | — | — | — | — | — | 0.07 | 0.01 | 0.07 | 0.096 | bal. |
| | q | 0.10 | — | — | — | — | — | 0.02 | 0.02 | 0.05 | 0.019 | bal. |
| | r | — | 0.02 | — | — | — | 0.02 | 0.02 | 0.02 | 0.04 | 0.010 | bal. |
| | s | — | — | 0.02 | — | — | 0.02 | 0.08 | 0.03 | 0.03 | 0.039 | bal. |
| | t | — | — | — | 0.02 | — | 0.02 | 0.04 | 0.04 | 0.03 | 0.008 | bal. |
| | u | — | — | — | — | 0.02 | 0.02 | 0.02 | 0.02 | 0.08 | 0.094 | bal. |
| | v | — | 0.02 | 0.05 | 0.04 | 0.02 | 0.13 | 0.01 | 0.01 | 0.06 | 0.048 | bal. |
| COMPARATIVE EXAMPLE | w | — | — | — | — | — | — | 0.02 | 0.04 | 0.07 | 0.089 | bal. |
| | x | — | — | — | — | — | — | 0.05 | 0.04 | 0.01 | 0.036 | bal. |
| | y | — | — | — | — | — | — | 0.05 | 0.04 | 0.09 | 0.030 | bal. |
| | z | — | — | — | — | — | — | 0.09 | 0.09 | 0.08 | 0.089 | bal. |
| | 2a | — | — | — | — | — | — | 0.07 | 0.07 | 0.07 | 0.096 | bal. |
| | 2b | — | — | — | — | — | — | 0.09 | 0.04 | 0.05 | 0.067 | bal. |
| | 2c | — | — | — | — | — | — | 0.06 | 0.02 | 0.08 | 0.002 | bal. |
| | 2d | 0.14 | — | — | — | — | — | 0.01 | 0.03 | 0.05 | 0.031 | bal. |
| | 2e | — | 0.05 | 0.08 | 0.06 | 0.05 | 0.24 | 0.03 | 0.06 | 0.05 | 0.099 | bal. |
| | 2f | — | — | — | — | — | — | 0.05 | 0.08 | 0.01 | 0.024 | bal. |
| | 2g | — | — | — | — | — | — | 0.05 | 0.08 | 0.05 | 0.060 | bal. |
| | 2h | — | — | — | — | — | — | 0.06 | 0.06 | 0.09 | 0.041 | bal. |

TABLE 2

| | No | MATERIAL | HEATING RATE (° C./s) | FINISH ANNEALING TEMPERATURE (° C.) | HOLDING TIME (min) | AVERAGE COOLING RATE (° C./s) |
|---|---|---|---|---|---|---|
| PRESENT INVENTION | 1 | a | 10.0000 | 650 | 1 | 0.190 |
| | 2 | a | 10.0000 | 650 | 10 | 0.160 |
| | 3 | a | 5.0000 | 650 | 30 | 0.080 |
| | 4 | a | 1.0000 | 650 | 180 | 0.030 |
| | 5 | a | 0.1000 | 650 | 2000 | 0.010 |
| | 6 | a | 0.0500 | 650 | 3500 | 0.008 |
| | 7 | a | 0.0500 | 650 | 4000 | 0.005 |
| | 8 | b | 0.0400 | 650 | 60 | 0.080 |
| | 9 | c | 0.0300 | 650 | 90 | 0.080 |
| | 10 | d | 0.0200 | 650 | 210 | 0.080 |
| | 11 | e | 0.0050 | 650 | 3500 | 0.008 |
| | 12 | f | 0.0050 | 650 | 3500 | 0.008 |
| | 13 | g | 0.0050 | 650 | 3500 | 0.008 |
| | 14 | h | 0.0050 | 650 | 3500 | 0.008 |
| | 15 | i | 0.0050 | 650 | 3500 | 0.008 |
| | 16 | j | 0.0050 | 650 | 3500 | 0.008 |
| | 17 | k | 0.0050 | 650 | 3500 | 0.008 |
| | 18 | l | 0.0050 | 650 | 3500 | 0.008 |
| | 19 | m | 0.0050 | 650 | 3500 | 0.008 |
| | 20 | n | 0.0050 | 650 | 3500 | 0.008 |
| | 21 | o | 0.0010 | 650 | 3500 | 0.008 |
| | 22 | p | 0.0050 | 650 | 3500 | 0.008 |
| | 23 | q | 0.0050 | 650 | 3500 | 0.008 |
| | 24 | r | 0.0050 | 650 | 3500 | 0.008 |
| | 25 | s | 0.0050 | 650 | 3500 | 0.008 |
| | 26 | t | 0.0050 | 650 | 3500 | 0.008 |
| | 27 | u | 0.0050 | 650 | 3500 | 0.008 |
| | 28 | v | 0.0050 | 650 | 3500 | 0.008 |
| | 29 | a | 0.0050 | 550 | 3500 | 0.008 |
| | 30 | a | 0.0050 | 780 | 3500 | 0.008 |
| COMPARATIVE EXAMPLE | 31 | a | 0.0050 | 650 | 3500 | 0.260 |
| | 32 | a | 0.0050 | 650 | 3500 | 0.250 |
| | 33 | a | 0.0050 | 650 | 3500 | 0.220 |
| | 34 | w | 0.0050 | 650 | 3500 | 0.080 |
| | 35 | x | 0.0050 | 650 | 3500 | 0.080 |
| | 36 | v | 0.0050 | 650 | 3500 | 0.080 |
| | 37 | z | 0.0050 | 650 | 3500 | 0.080 |
| | 38 | 2a | 0.0050 | 650 | 3500 | 0.080 |
| | 39 | 2b | 0.0050 | 650 | 3500 | 0.080 |
| | 40 | 2c | 0.0050 | 650 | 3500 | 0.080 |
| | 41 | 2d | 0.0050 | 650 | 3500 | 0.080 |
| | 42 | 2e | 0.0050 | 650 | 3500 | 0.080 |
| | 43 | 2f | 0.0050 | 650 | 3500 | 0.080 |
| | 44 | 2g | 0.0050 | 650 | 3500 | 0.080 |
| | 45 | 2h | 0.0050 | 650 | 3500 | 0.080 |
| | 46 | a | 11.0000 | 650 | 3500 | 0.080 |
| | 47 | a | 0.0050 | 500 | 3500 | 0.080 |
| | 48 | a | 0.0050 | 800 | 3500 | 0.080 |
| | 49 | a | 0.0050 | 650 | 0.5 | 0.080 |

TABLE 3

| | No | AREA RATIO OF β-GRAINS (%) | AVERAGE GRAIN DIAMETER OF β-GRAINS (μm) | PRESENCE OF INTERMETALLIC COMPOUNDS OR INCLUSIONS | AVERAGE (Fe + Cr + Ni + Mo)/(Pt + Pd + Ru + Ir + Os + Rh) RATIO IN β-GRAINS | NUMBER RATIO OF β-GRAINS CORRODED INTO PITS (%) | CORROSION RATE (mm/year) |
|---|---|---|---|---|---|---|---|
| PRESENT INVENTION | 1 | 1 | 0.3 | NO | 0.587 | 0 | 0.042 |
| | 2 | 4 | 0.5 | NO | 0.619 | 0 | 0.031 |
| | 3 | 4 | 0.8 | NO | 0.613 | 0 | 0.024 |
| | 4 | 4 | 1.4 | NO | 0.661 | 0 | 0.021 |
| | 5 | 4 | 2.9 | NO | 0.779 | 0 | 0.022 |
| | 6 | 4 | 4.8 | NO | 0.771 | 0 | 0.025 |
| | 7 | 4 | 3.5 | NO | 0.851 | 0 | 0.051 |
| | 8 | 5 | 4.2 | NO | 1.655 | 0 | 0.075 |
| | 9 | 3 | 2.2 | NO | 0.993 | 0 | 0.054 |
| | 10 | 8 | 3.3 | NO | 1.284 | 0 | 0.072 |
| | 11 | 5 | 4.8 | NO | 0.882 | 0 | 0.062 |
| | 12 | 2 | 4.1 | NO | 0.562 | 0 | 0.071 |
| | 13 | 10 | 4.8 | NO | 0.551 | 0 | 0.051 |
| | 14 | 8 | 4.5 | NO | 0.555 | 0 | 0.062 |
| | 15 | 2 | 4.9 | NO | 0.553 | 0 | 0.079 |
| | 16 | 3 | 3.3 | NO | 0.553 | 0 | 0.061 |

TABLE 3-continued

| | No | AREA RATIO OF β-GRAINS (%) | AVERAGE GRAIN DIAMETER OF β-GRAINS (μm) | PRESENCE OF INTERMETALLIC COMPOUNDS OR INCLUSIONS | AVERAGE (Fe + Cr + Ni + Mo)/(Pt + Pd + Ru + Ir + Os + Rh) RATIO IN β-GRAINS | NUMBER RATIO OF β-GRAINS CORRODED INTO PITS (%) | CORROSION RATE (mm/year) |
|---|---|---|---|---|---|---|---|
| | 17 | 5 | 4.9 | NO | 0.626 | 0 | 0.028 |
| | 18 | 5 | 4.4 | NO | 0.668 | 0 | 0.031 |
| | 19 | 6 | 4.6 | NO | 0.659 | 0 | 0.025 |
| | 20 | 2 | 1.1 | NO | 1.555 | 7 | 0.078 |
| | 21 | 2 | 0.6 | NO | 1.796 | 9 | 0.096 |
| | 22 | 3 | 2.2 | NO | 1.687 | 8 | 0.085 |
| | 23 | 10 | 5.0 | NO | 0.559 | 0 | 0.011 |
| | 24 | 9 | 4.9 | NO | 0.722 | 0 | 0.011 |
| | 25 | 5 | 4.6 | NO | 0.986 | 0 | 0.011 |
| | 26 | 3 | 4.8 | NO | 1.336 | 0 | 0.012 |
| | 27 | 7 | 4.3 | NO | 1.573 | 0 | 0.011 |
| | 28 | 10 | 5.0 | NO | 1.682 | 0 | 0.012 |
| | 29 | 7 | 4.4 | NO | 1.984 | 9 | 0.027 |
| | 30 | 10 | 5.0 | NO | 0.555 | 0 | 0.015 |
| COMPARATIVE EXAMPLE | 31 | 10 | 5.0 | NO | 0.352 | 30 | 0.415 |
| | 32 | 9 | 4.9 | NO | 0.396 | 25 | 0.443 |
| | 33 | 8 | 4.9 | NO | 0.514 | 20 | 0.387 |
| | 34 | 1 | 10.1 | YES | 2.435 | 85 | 0.379 |
| | 35 | 2 | 5.8 | NO | 2.021 | 20 | 0.395 |
| | 36 | 1 | 7.1 | YES | 2.798 | 95 | 0.421 |
| | 37 | 9 | 14.5 | NO | 0.442 | 20 | 0.119 |
| | 38 | 9 | 11.9 | NO | 0.496 | 15 | 0.101 |
| | 39 | 1 | 0.2 | NO | 2.279 | 75 | 0.415 |
| | 40 | 12 | 9.9 | NO | 0.186 | 40 | 0.368 |
| | 41 | 10 | 3.3 | YES | 0.338 | 35 | 0.315 |
| | 42 | 1 | 7.7 | NO | 2.028 | 50 | 0.415 |
| | 43 | 1 | 6.3 | NO | 2.012 | 15 | 0.368 |
| | 44 | 1 | 12.5 | YES | 0.095 | 70 | 0.444 |
| | 45 | 1 | 13.5 | NO | 0.187 | 80 | 0.372 |
| | 46 | 3 | 21.1 | NO | 0.513 | 12 | 0.095 |
| | 47 | 6 | 4.1 | NO | 0.115 | 50 | 0.450 |
| | 48 | 14 | 5.5 | NO | 2.005 | 60 | 0.173 |
| | 49 | 2 | 0.2 | NO | 0.053 | 80 | 0.330 |

Hereinabove, the preferred embodiments of the present invention have been explained in detail, but the present invention is not limited to such examples. It is apparent that a person ordinary skilled in the art to which the present invention pertains is able to devise various changed or modified examples within the scope of the technical ideas as set forth in claims, and it should be understood that such examples belong to the technical scope of the present invention as a matter of course.

What is claimed is:

1. A titanium alloy having an α-phase and a β-phase, containing: by mass %,

Fe: 0.010 to 0.300%,

Ru: 0.010 to 0.150%,

Cr: 0 to 0.10%,

Ni: 0 to 0.30%,

Mo: 0 to 0.10%,

Pt: 0 to 0.10%,

Pd: 0 to 0.20%,

Ir: 0 to 0.10%,

Os: 0 to 0.10%,

Rh: 0 to 0.10%, one or more types of La, Ce, and Nd: 0 to 0.10% in total, one or more types of Cu, Mn, Sn, and Zr: 0 to 0.20% in total, C: 0.10% or less, N: 0.05% or less, O: 0.20% or less, H: 0.100% or less, with the balance made up of Ti and impurities, wherein an area ratio of the β-phase crystal grains is in a range of 1 to 10%, and an average crystal grain diameter of the β-phase crystal grains is in a range of 0.3 to 5.0 μm, and an average value of an A-value in Expression (1) below, which represents a composition ratio of elements contained in β-phase crystal grains, is in a range of 0.550 to 2.000, $$A=([Fe]+[Cr]+[Ni]+[Mo])/([Pt]+[Pd]+[Ru]+[Ir]+[Os]+[Rh]) \quad (1)$$

wherein, each indication of [element symbol] in Expression (1) indicates an elemental concentration (mass %) in the β-phase crystal grains.

* * * * *